US006301091B1

(12) United States Patent
Zomchek et al.

(10) Patent No.: US 6,301,091 B1
(45) Date of Patent: Oct. 9, 2001

(54) RELAY CONFIGURATION

(75) Inventors: Kevin M. Zomchek, Milwaukee; Paul C. Brown, Muskego; Homer S. Sambar, Shorewood, all of WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/300,626

(22) Filed: Apr. 27, 1999

(51) Int. Cl.[7] ..... H01H 9/20; H01H 9/54

(52) U.S. Cl. ..... 361/189; 361/166; 361/192; 307/140; 307/328

(58) Field of Search ..... 361/23, 166, 167, 361/189, 190, 191, 160, 192, 194, 198; 318/434; 388/903; 192/129 R; 307/139, 142, 115, 140, 141.8, 328

(56) References Cited

U.S. PATENT DOCUMENTS 3,371,254 * 2/1968 Hagfors ..... 317/135
3,898,527 * 8/1975 Cawley ..... 317/13
4,406,982 * 9/1983 McClellan, Jr. ..... 318/345
4,418,374 * 11/1983 Callan ..... 361/167
4,502,084 * 2/1985 Hannett ..... 361/23
5,689,398 * 11/1997 Miller et al. ..... 361/189

* cited by examiner

*Primary Examiner*—Josie Ballato
*Assistant Examiner*—Vaughn Marquis
(74) *Attorney, Agent, or Firm*—Michael A. Jaskolski; Alexander M. Gerasimow; William R. Walbrun

(57) ABSTRACT

A safety relay configuration for linking a power source to a device to be powered via at least one output wherein output contacts all have to be closed to provide power to the device, the configuration including first and second three contact relays or four contact relays, each relay including a first NC contact and at least two NO contacts and, wherein the second relay first contact is linked in parallel with the first relay second contact forming a first parallel configuration, the first relay first contact is linked in parallel with the second relay second contact forming a second parallel configuration, the first parallel configuration is linked in series with the first relay coil between the power source and ground, the second parallel configuration is linked in series with the second relay coil between the power source and ground and the relay third contacts are linked within the outputs between the power source and the device. Where the relays have four contacts, the relay fourth contacts are linked within the outputs between the power source and the device.

14 Claims, 2 Drawing Sheets

RELAY CONFIGURATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to safety relay circuit configurations and more particularly to a relay configuration including two 4-contact relays arranged to provide power to a device wherein, when any of the components or contacts fails, device power is cut off within one cycle period.

Many devices require electrical power to run. For instance, an exemplary factory often includes many motors which are linked to other devices (e.g. robots) for loading items to be assembled or machined onto an assembly line or machining line, moving items along a line, moving tools adjacent a line to assemble items and to machine items and to remove items from a line. While the inventive relay configuration is meant to be used with many device types, to simplify the present explanation the invention will be described in the context of, and with respect to, a simple motor linked to a metal milling machine.

To provide power to a motor, primitive systems simply included an on/off switch, power provided when the switch was closed and cut off when the switch was opened. While primitive on/off switches achieve desired control when they operate properly, unfortunately, under certain circumstances a system relying on such a primitive on/off switch to control power to a motor can become uncontrolled.

Uncontrolled circumstances have two general causes: (1) a failed witch and (2) an inadvertent hot wire. With respect to a failed switch, start switches have been known to fuse closed when a rated contact current is exceeded. Because many power sources are not well regulated, current surges are common and, therefore, fused start switches occur on occasion. Where a start switch fuses closed, there is no quick way to turn off the motor in an emergency situation and uncontrolled motor operation occurs.

With respect to inadvertent hot wires, in a complex industrial environment, sometimes an inadvertent wire may exist which either short circuits the start switch or provides power from another source to the motor by bypassing the switch. In this case, as in the case where the start switch is fused, there is no quick way to cut off motor power and uncontrolled motor operation occurs.

In any case, uncontrolled operation can be extremely dangerous. For example, a milling machine which cannot be turned off may damage itself, an item to be milled or tools or equipment within the vicinity of the machine. In addition, a machine which cannot be turned off may also injure or even kill a person within the path of a milling bit or, if the machine malfunctions, may injure or kill a person who is simply passing by the machine.

To avoid uncontrolled operation resulting from a fused start switch, the industry has developed various safety relay configurations. A relay is a device which includes at least one coil and an associated contact. A contact is essentially a two state switch having a normal state (i.e. open or closed) and an excited state (i.e. the opposite of the normal state). A contact having a normally closed state is referred to as an NC contact while a contact having a normally open sate is referred to as an NO contact. When current passes through the coil, the relay changes contact states. Thus, when the coil is excited, NC contacts open and NO contacts close. In many cases a relay will include more than a single contact. For example, a relay may include three NO contacts and one NC contact or five NO contacts and one NC contact. In a relay having three NO contacts and one NC contact, when the coil is excited, all three NO contacts close and the NC contact opens.

A safety relay configuration typically includes, among other things, one or more relays, one or more NC emergency stop (ES) switches, a start switch and a logic power source (i.e. a second power source in addition to the motor driving power source). Typical configurations include both a control circuit and at least one output. A control circuit is designed to effectively "determine" whether or not an operator wants power to be delivered to the motor based on a recent sequence of start and stop commands selected via the start and ES switches.

The output is designed to either provide power to, or cut power off from, the motor based on operation of the control circuit. To this end, an output typically includes one or more relay contacts (hereinafter "output contacts") in series between the driving source and the motor, each of the output contacts having to be closed to provide power to the motor.

The control circuit is designed such that, when the start switch is closed, the relay coils are excited causing the output contacts to close (thereby providing power to the motor).

The ES switches are arranged such that when the ES switches are opened, coil current is cut off and all properly operating contacts associated therewith change state (i.e. closed contacts open and open contacts close). Thus, when the ES switches are opened, the output contacts open and power to the motor is cut off. After power is cut off, assuming properly operating contacts, power can again be provided by closing the start switch. The process of cutting off power via ES switches and again providing power via the start switch is referred to as a cycle.

To avoid uncontrolled operation resulting form an inadvertent hot wire, one prevalent solution has been to provide more than one output between a driving source and the motor wherein the contacts in all outputs have to be closed to provide power to the motor. For example, a configuration including two outputs may include a first output having first and second NO contacts and a second output having third and fourth NO contacts. In this case power is only provided to the motor when all of the first through fourth contacts are closed. Here, while an inadvertent wire may short the contacts in the first output, although possible, it is unlikely that the inadvertent wire or another inadvertent wire would short the contacts in the second output. Thus, even if the first output contacts where shorted or bypassed, the second output would still facilitate control (i.e. by opening one of the second output contacts, power to the motor is cut). Clearly the number of outputs should be maximized for redundancy purposes and, in any event, at least two outputs should be provided.

There are uses for relay configurations which are relatively safe and other uses for relay configurations wherein the likelihood of injury to a person or damage to the system or other items within the vicinity of the system is relatively more likely. For this reason, the industry has developed a hierarchy of relay configuration safety categories, each category specifying configuration requirements for specific applications. For example, a first relatively low safety category may specify that a configuration must simply identify a contact which is fused closed so that an associated relay can be replaced or repaired to avoid subsequent system down time.

On the other hand, a second relatively high safety category may specify that a configuration must detect single component failure (i.e. a fused contact) within one cycle (i.e. power cut off and attempted reapplication) and, despite failure, must maintain ES switch operation and disable the start switch from reapplying power to the motor once power is cut off. Other categories between the first and second categories identified above are specified by the industry.

The inventive configuration has been designed to meet or exceed the second safety category described above. That is, the inventive configuration detects single component failure within one cycle and, despite failure, maintains operable ES switches and disables the start switch from reapplying power to the motor once power is cut off. Hereinafter, configurations generally which meet or exceed the requirements specified by the second category above are referred to as maximum safety configurations.

As well known in the controls art, while the costs of most devices (e.g. resistors, diodes, capacitors, etc.) in a relay configuration are minimal, relays are relatively expensive devices. This is particularly true where more than a single relay type is required to configure a relay configuration as more than one part type must be manufactured and stocked for initial construction and replacement. While many different maximum safety configurations (i.e. configurations which meet or exceed the second safety category specifications indicated above) have been designed and manufactured, most maximum safety configurations are relatively complex requiring a plurality (e.g. 3–4) of relays and often requiring more than one relay type. Thus, a maximum safety configuration's cost is closely related to the type and number of relays required to construct the configuration. For these reasons the industry is constantly searching for a maximum safety relay configuration which requires relatively inexpensive identical relays and which requires a minimal number of relays. In addition, to avoid uncontrolled operation caused by inadvertent hot wires, such a relay should have at least two outputs.

BRIEF SUMMARY OF THE INVENTION

An exemplary embodiment of the invention includes a two relay safety switching configuration which, after power is cut off to a motor, if one or more relay contacts has failed (i.e. fused into a closed position), disables a control circuit from providing power to the motor until the contact is repaired or replaced.

To this end, the invention includes a switching configuration for linking a power source to a device to be powered via at least one output, the at least one output including output contacts, each output contact having to be closed to provide power to the device. The configuration includes first and second relays, the first relay including a first normally closed contact and second and third normally open contacts and a first coil, the second relay including a first normally closed contact and second and third normally open contacts and a second coil, each of the first relay contacts changing state when the first coil is energized and each of the second relay contacts changing state when the second coil is energized.

The second relay first contact is linked in parallel with the first relay second contact forming a first parallel configuration, the first relay first contact is linked in parallel with the second relay second contact forming a second parallel configuration, the first parallel configuration is linked in series with the first coil between the power source and ground, the second parallel configuration is linked in series with the second coil between the power source and ground and the relay third contacts are linked within the at least one output between the power source and the device. In the alternative, where there are two outputs, one of the third contacts is within the first output and the other third contact is within the second output.

In a preferred embodiment, each of the first and second relays also includes a fourth normally open contact, the first and second relay third contacts are in series in a first output and the first and second relay fourth contacts are in series in a second output.

Preferably the configuration includes a first voltage storage device (i.e. capacitor) linked in parallel across the first coil and a second voltage storage device linked in parallel across the second coil and transistor, a NO start switch linked in series with the second relay first contact, a transistor is linked in series with first relay first contact, a base of the transistor linked to a node between the start contact and the second relay first contact and at least a first NC emergency stop switch linked in series with the first parallel configuration and the first coil and a second NC emergency stop switch linked in series with the second parallel configuration and the second coil.

Also, preferably a resistor is provided in series with the first relay first contact, the resister and first relay first contact in parallel with the second relay second contact. The resistor prohibits starting and stopping using only emergency switches while the start button is shorted or "tied-down".

In yet another embodiment, a resistor may be placed in series between the first relay first contact and a node between the first coil and a first emergency stop switch. Once again, the resistor prohibits emergency switch starting and stopping during tie-down conditions. An optional short across the resistor may also be provided. Where the short is closed across the resistor, tie-down emergency starting and stopping can occur and the configuration will because starting independent of a time differential duration between emergency witch closure.

Thus, the primary object of the invention is to provide a safety relay configuration which identifies single contact failure within a single cycle.

Another object is to achieve the aforementioned object as inexpensively as possible. To this end, the present configuration requires only two four-contact relays or two three-contact relays to identify single contact failure and cut off motor power thereafter.

One other object is to provide two outputs for redundancy purposes. The invention achieves this object despite including only two relays.

Another object is to provide a configuration which prohibits emergency switch starting and stopping. Two embodiments including resistors achieve this object.

Yet another object is to provide a configuration which, when a start switch is tied down, enables emergency switch starting and stopping independent of the duration of a time interval between emergency switch closure.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

A. Hardware

The inventive safety relay configuration includes, among other components, first and second relays generally referred to as K1 and K2, respectively. Hereinafter, when referring to any components which forms a part of the first relay K1, the component will be referred to by the identifier "K1" followed by some other identifying character. For example, when referring to the inductive coil of a first relay K1, the inductive coil will be referred to as K1i, when referring to the first contact of first relay K1, the first contact will be referred to as contact K11, when referring to the fourth contact of first relay K1, the fourth contact will be referred to as K14, and so on. Similarly, when referring to any component of the second relay K2, the component will be referred to by the identifier "K2" followed by some other identifying character. For example, when referring to the inductive coil of second relay K2, the inductive coil will be referred to as K2i, when referring to the third contact of second relay K2, the third contact will be referred to as K23, and so on.

Figure 1:
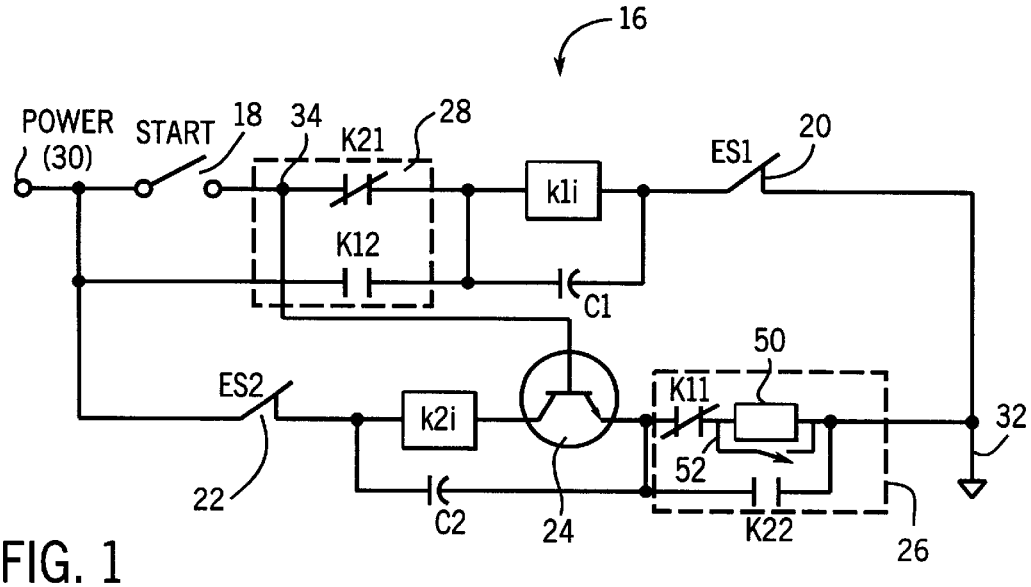
FIG. 1 is a schematic diagram of a control circuit portion of an inventive safety relay configuration.
Figure 2:
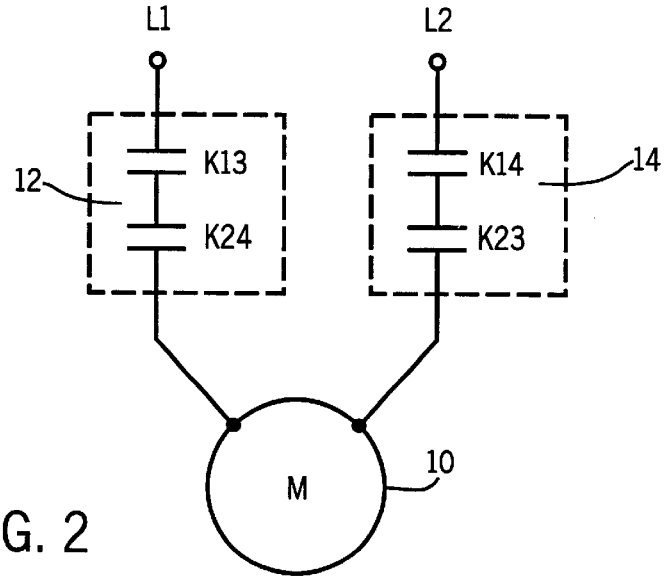
FIG. 2 is a schematic diagram of first and second outputs of the inventive safety relay configuration which are controlled by the control circuit of FIG. 1.

Referring to both FIGS. 1 and 2 the inventive safety relay configuration includes all of the components (except the motor 10 illustrated in FIG. 2) illustrated. A control circuit according to the present invention is illustrated in FIG. 1 while two separate outputs 12 and 14 are illustrated in FIG. 2.

The first positively guided relay K1 includes a first inductive coil K1i, a first normally closed (NC) contact K11 and second, third and fourth normally opened (NO) contacts K12, K13 and K14, respectively. Similarly, the second positively guided relay includes second inductive coil K2i, a first NC contact K21 and second, third and fourth NO contacts K22, K23 and K24, respectively. As well known in the relay art, after any NO relay contact fuses into a closed state (i.e. contact leads are welded together causing failure), the states of all NC contacts on the same relay must remain open even when power to the coils is removed. Thus, if the first relay second contact K12 is fused in its closed state, the K11 contact is effectively frozen in its open state and cannot be caused to close by coil K1i.

When current passes through coil K1i, all first relay contacts K11, K12, K13 and K14 change state. Thus, when coil K1i is excited, first contact K1 changes from its NC state to an open stated while of each contacts K12, K13 and K14 change from their NO states to a closed state. Similarly, when current passes through coil K2i, each of contacts K21, K22, K23 and K24 change state. Thus, when current is provided to coil K2i, contact K21 changes from its NC state to an open state and contact K22, K23 and K24 change from their NO states to closed states.

Referring now to FIG. 1, the control circuit 16 includes a NO start switch 18, a first normally closed emergency stop switch 20, a second normally closed emergency stop switch 22, a transistor 24, a first voltage storage device in the form of a capacitor C1, a second voltage storage device in the form of a capacitor C2, first relay coil K1i, second relay coil K2i, first relay contacts K11 and K12 and second relay contacts K21 and K22. All of the components of control circuit 16 are arranged between a power source 30 and a ground 32. In this embodiment block 50 is a short circuit.

First relay first contact K11 is in series with transistor 24 which are together in parallel with second relay second contact K22 forming a first parallel construction 26. Similarly, second relay first contact K21 is in series with start switch 18 which are together in parallel with first relay second contact K12 forming a second parallel construction 28. Second parallel construct 28 is linked to source 30. First coil K1i and first emergency stop switch 20 are arranged in series between second parallel construction 28 and ground 32. First capacitor C1 is linked in parallel with first coil K1i.

Second emergency stop switch 22, second coil K2i, 24 and first parallel construction 26 are arranged in series between source 30 and ground 32. Transistor 24 is arranged such that its collector is linked to coil K2i and its emitter is linked to contact K11, the transistor base linked to a node 34 between start button 18 and contact K21.

Each of ES switches 20 and 22 is linked to one activation device or ES button (not shown) such that both switches are open when the activation device is activated.

Referring now to FIG. 2, two power leads L1 and L2 are provided which are connected to a power source (not illustrated) and pass through first and second outputs 12, 14, respectively, to motor 10. Output 12 includes first relay third contact K13 and second relay fourth contact K24 arranged in series between lead L1 and motor 10. Similarly, second output 14 includes first relay fourth contact K14 and second relay third contact K23 arranged in series between lead L2 and motor 10. In order to provide power to motor 10, all contacts K13, K24, K14 and K23 have to be closed. If any one of the output contacts is open, power is cut off from motor 10.

With the relays and other components arranged as described above, if any relay contact fails, failure of the contact is identified within one cycle wherein a cycle is the occurrence of opening one of the ES switches 20 or 22 to cut power off to the motor 10 and an attempt to reapply power to the motor by closing start switch 18.

B. Operation

In operation, referring to FIGS. 1 and 2, to start motor 10, a start button (not illustrated) which is linked to switch 18 is pressed and released which causes switch 18 to close. When switch 18 is closed, current is provided through NC contact K21 and first capacitor C1 begins charging. In addition, current is provided to the base of transistor 24 thereby causing transistor current flow and capacitor C2 begins to charge. Eventually, once capacitors C1 and C2 become charged, current passes through coils K1i and K2i.

As described above, when current passes through coils K1i and K2i associated contacts change state. Therefore, the output coils K13, K24, K14 and K23 each close thereby providing power to motor 10. In addition, referring to FIG. 1, when coil K1i conducts, contact K12 closes and contact K11 opens. However, at the same time, as coil K2i conducts, contacts K2i opens and K22 close. If contact K21 opens before contact K12 closes, capacitor C1 will discharge providing current to coil K1i until contact K12 is closed. Similarly, if contact K11 opens before contact K22 closes, capacitor C2 discharges providing current to coil K2i until contact K22 is closed. Thus, shortly after closing start switch 18, referring to FIG. 1, current passes through contact K12, coil K1i and emergency stop switch 20 to ground thereby maintaining coil K1i in an excited state and thus maintaining output contacts K13 and K14 (see FIG. 2) closed. Similarly, shortly after start switch 18 is closed, current flows through emergency stop switch 22, coil K2i, and contact K22 to ground thereby maintaining coil K2i excited and maintaining output contacts K24 and K23 (see FIG. 2) closed.

If motor 10 has to be stopped quickly for some reason, ES switches 20, 22 are opened thereby cutting power to coils K1i and K2i and causing output contacts K13, K14, K23 and K24 to open, thus cutting power to motor 10. To start motor 10 again, ES switches 20, 22 are reset (i.e. closed), switch 18 is simply reclosed and the start process above is repeated.

Now, assume motor 10 is powered and contact K13 fails and is fused into its closed state. Here, because a contact has fused (i.e. failed), after motor power is cut off, a user should not be able to restart motor 10 until the relay including the fused contact is repaired or replaced. Because contact K13 is fused closed, the first relay NC contacts are held open by the fused contact K13. Hence, contact K1 is maintained open. In this case, when the emergency stop button (not illustrated) is pressed, each of ES switches 20 and 22 is instantaneously opened. In this case, current is cut off to each of coils K1i and K2i. Because coil K2i stops conducting current, all second relay contacts change state. Hence, referring to FIG. 2, each of second relay contacts K24 and K23 open. In addition, contact K21 closes and contact K22 opens. ES switches 20 and 22 remain open until reset.

After ES switches 20 and 22 are reset (i.e. closed), when start switch 18 is again closed to start motor 10, because contact K11 is maintained open (i.e. via fused contact K13), no current passes through coil K2i and therefore all second relay contacts, including output contacts K24 and K23 remain open. Hence, no power is provided to motor 10.

Similar operation occurs to block motor power when either of contacts K12 or K14 fuses. If contact K11 fuses, despite coil K1i current, output contacts K13 and K14 cannot close and power cannot be provided to the motor.

Also, similarly, when any of contacts K22, K23 or K24 fuse closed, contact K21 remains open and, when start switch 18 is closed no current is provided to coil K1i so that coils K13 and K14 cannot be closed and no power is provided to motor 10. When contact K21 fuses, despite coil K2i current, output contacts K23 and K24 cannot close and motor power is cut.

Thus, it should be appreciated that a simple two relay safety configuration has been described which has particularly advantageous safety features. For example, when any single contact fails in the inventive relay configuration, power cannot be provided to motor 10. In addition, two outputs are provided.

C. Modifications

One problem with safety relay configurations is that machine operators may attempt to modify a safety configuration to make the starting and stopping process more efficient and the modification may result in a dangerous situation. For example, referring to FIG. 1, often an operator will "tie down" the start button linked to switch 18 so that the motor or other device controlled by configuration 16 can be started and stopped via emergency switches 20 and 22 alone. Unfortunately such tie-down conditions are often dangerous and therefore it would be desirable to have a configuration which fails to start when tie-down conditions exist.

To this end, instead of providing a short circuit at block 50, a resistor is provided at block 50. Hereinafter block 50 will be referred to as resistor 50. With resistor 50 placed in series with NC contact K11, if switch 18 is tied down in a closed position, resistor 50 causes a time variation between the time required to excite coils K1i and K2i. Because of the excitation time difference, coil K1i causes contact K11 to open prior to coil K2i causing contact K22 to close. Because contact K11 opens and contact K22 fails to close, current through coil K2i is cut off, NO contacts associated with coil K2i, including K23 and K24, do not close and motor 10 cannot be started. Thus, resistor 50 renders motor 10 unstartable when switch 18 is tied down.

If desired, an optional short 52 may be provided across resistor 50 so that resistor 50 may be jumped to allow tie-down emergency stops and starts. Typically, while the button linked to switch 18 is accessible to a system operator, resistor 50 and short 52 are not. Instead, resistor 50 and short 52 are typically only accessible to a controls engineer who, familiar with the dangers inherent in a control application, can make an informed decision to stop and start whether an operator should be allowed to stop and start using ESs alone. If an application is judged relatively dangerous, resistor 50 is not shorted. If an application is judged relatively safe, resistor 50 is jumpered. Thus, short 52 provides a degree of versatility to configuration 16.

Referring still to FIG. 1, assuming either block 50 is a short or that short 52 is used to jump resistor 50, another relay configuration problem stems from the fact that there may be a time differential between the times when switches 20 and 22 close. For example, switches 20 and 22 may be located at top and bottom edges, respectively, of a large door which wobbles when closing such that switch 20 may close before switch 22 or vice versa.

If the time differential between switches 20 and 22 closing is sufficiently long, the coil in series with the switch which closes first will excite and open the related contact in series with the other coil. For example, if switch 20 closes before switch 22, coiled K1i may open contact K11 prior to coil K2i being excited sufficiently to close contact K22. If contact K11 opens before contact K22 closes, motor 10 will not start.

Figure 3:
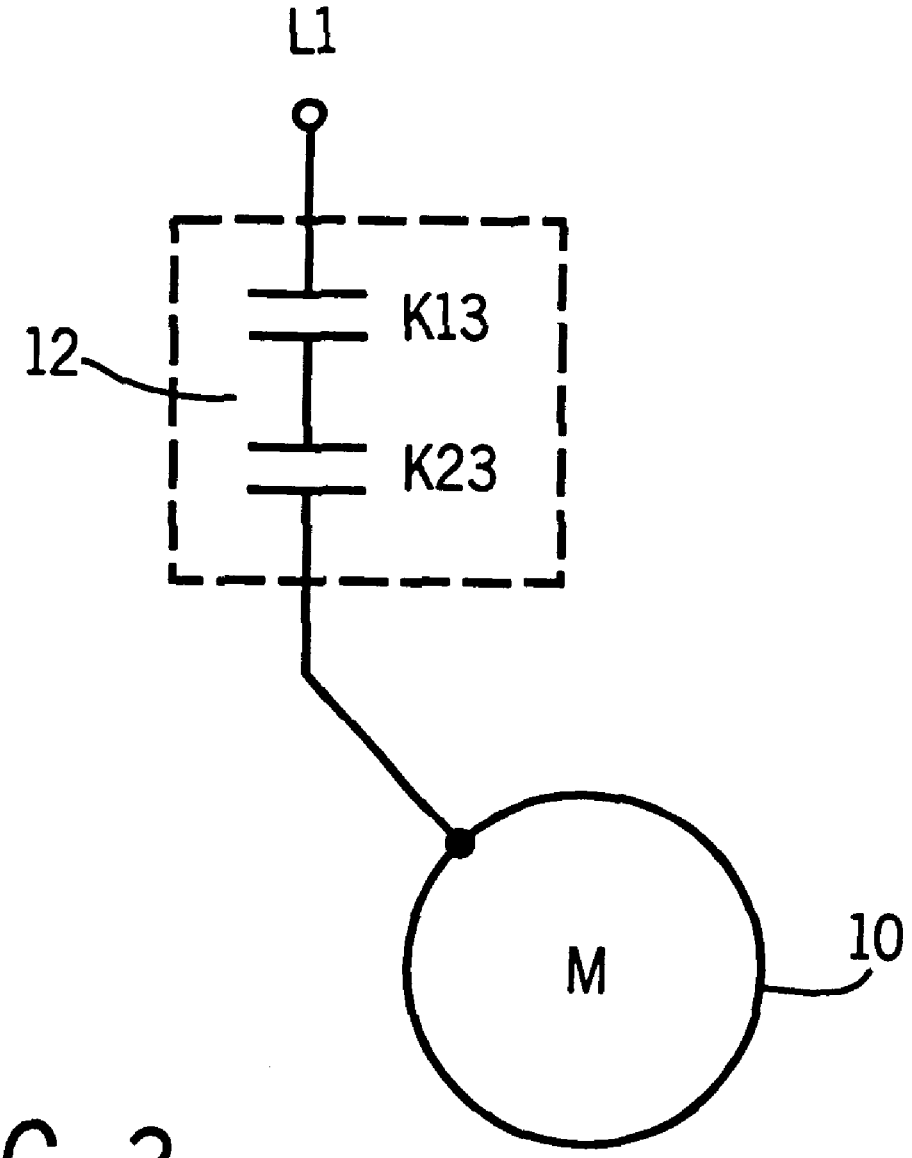
FIG. 3 is similar to FIG. 1 albeit illustrating only one output instead of two.

It should be understood that the methods and apparatuses described above are only exemplary and do not limit the scope of the invention, and that various modifications could be made by those skilled in the art that would fall under the scope of the invention. For example, while the preferred embodiment includes two outputs and first and second output contacts in each of the outputs wherein each first output contact is a first relay contact and each second output contact is a second relay contact, clearly other output configurations are contemplated. For example, referring to FIG. 3, one configuration may include a single output L1 including one first relay contact K13 and one second relay contact K23 in series. As another example, another configuration may include two outputs wherein each output only includes a single contact, the first including a first relay contact and the second output including a second relay contact. Moreover, more than two outputs may be provided. To this end, there may be four outputs wherein each output includes a single contact, the first output including first relay contact K13, the second output including first relay contact K14, the third output including the second relay contact K24 and the fourth output including the second relay contact K23. Other configurations of outputs are contemplated.

In addition, referring to FIG. 1, transistor 24 may be placed where it is illustrated, or, in the alternative, could be placed in any series configuration with emergency stop 22, coil K2i and first parallel construction 26 between source 30 and ground 32. Similarly, start button 18 may also be placed in other locations.

To apprise the public of the scope of this invention, the following claims are made:

What is claimed is:

1. A safety switching configuration for linking a power source to a device to be powered via at least one output, the at least one output including output contacts, each output contact having to be closed to provide power to the device, the configuration comprising:

first and second relays, the first relay including a first normally closed contact and second and third normally open contacts and a first coil, the second relay including a first normally closed contact and second and third normally open contacts and a second coil, each of the first relay contacts changing state when the first coil is energized and each of the second relay contacts changing state when the second coil is energized;

wherein:

the second relay first contact is linked in parallel with the first relay second contact forming a first parallel configuration;

the first relay first contact is linked in parallel with the second relay second contact forming a second parallel configuration;

the first parallel configuration is linked in series with the first coil between the power source and ground;

the second parallel configuration is linked in series with the second coil between the power source and ground; and the relay third contacts are linked within the at least one output between the power source and the device.

2. The configuration of claim 1 wherein the at least one output includes at least first and second outputs, the first relay third contact is within the first output and the second relay third contact is within the second output.

3. The configuration of claim 2 wherein the first relay includes a fourth NO contact and the second relay includes a fourth NO contact and, wherein, each of the relay fourth contacts are within the outputs between the power source and the device.

4. The configuration of claim 3 wherein there are only the first and second outputs, the second relay fourth contact is in series with the first relay third contact and the first relay fourth contact is in series with the second relay third contact.

5. The configuration of claim 1 wherein the at least one output is a single output and the relay third contacts are in series between the power source and the device.

6. The configuration of claim 1 further including a first voltage storage device linked in parallel across the first coil and a second voltage storage device linked in parallel across the second coil.

7. The configuration of claim 6 further including a NO start switch linked in series with the second relay first contact.

8. The configuration of claim 7 wherein a transistor is linked in series with first relay first contact, a base of the transistor linked to a node between the start contact and the second relay first contact.

9. The configuration of claim 6 wherein each of the voltage storage devices is a capacitor.

10. The configuration of claim 1 further including at least a first NC emergency stop switch linked between the first coil and ground and a second NC emergency stop switch linked between the power source and the second coil.

11. A safety switching configuration for linking a power source to a device to be powered via at least first and second outputs, each output including output contacts, all of the output contacts having to be closed to provide power to the device, the configuration comprising:

first and second relays, the first relay including a first normally closed contact and second and third normally open contacts and a first coil, the second relay including a first normally closed contact and second and third normally open contacts and a second coil, each of the first relay contacts changing state when the first coil is energized and each of the second relay contacts changing state when the second coil is energized;

a NO start switch;

first and second NC stop switches;

first and second capacitors; and a transistor wherein:

the second relay first contact is linked in parallel with the first relay second contact forming a first parallel configuration;

the first relay first contact is linked in parallel with the second relay second contact forming a second parallel configuration;

the first parallel configuration is linked in series with the first coil between the power source and ground;

the second parallel configuration is linked in series with the second coil between the power source and ground;

the first relay third contact is linked in series between the power source and the device in the first output;

the second relay third contact is linked in series between the power source and the device in the second output;

the first NC stop switch linked in series with the first parallel configuration and the first coil and the second NC emergency stop contact linked in series with the second parallel configuration and the second coil;

the first capacitor linked in parallel across the first coil and the second capacitor linked in parallel across the second coil and transistor; and the start switch linked in series with the second relay first contact and the transistor linked in series with the first relay first contact, a base of the transistor linked to a node between the start contact and the second relay first contact.

12. The configuration of claim 11 wherein the first relay first contact is in series with a resistor and the first relay first contact and the resistor are in parallel with the second relay second contact forming the second parallel configuration.

13. The configuration of claim 12 further including an optional short in parallel with the resistor.

14. A safety switching configuration for linking a power source to a device to be powered via at least first and second outputs, each output including output contacts, all of the output contacts having to be closed to provide power to the device, the configuration comprising:

first and second relays, the first relay including a first normally closed contact and second and third normally open contacts and a first coil, the second relay including a first normally closed contact and second and third normally open contacts and a second coil, each of the first relay contacts changing state when the first coil is energized and each of the second relay contacts changing state when the second coil is energized;

a NO start switch;

first and second NC stop switches;

first and second capacitors; and a transistor wherein:

the second relay first contact is linked in parallel with the first relay second contact forming a first parallel configuration;

the start switch is linked in series between the first parallel configuration and the power source;

the first parallel configuration is linked in series between the first coil and the start switch;

the first NC stop switch is linked in series between the first coil and ground;

the second NC stop switch is linked in series between the second coil and the power source;

the transistor linked in series between the second coil and the first relay first contact, a base of the transistor linked to a node between the start contact and the second relay first contact;

the first relay first contact linked in series between the transistor and a node between the first coil and the first emergency stop switch;

the second relay second contact linked between the ground and a node between the second coil and the transistor;

the first capacitor linked in parallel across the first coil and the second capacitor linked in parallel across the second coil and transistor;

the first relay third contact is linked in series between the power source and the device in the first output; and the second relay third contact is linked in series between the power source and the device in the second output.

* * * * *